US005875861A

United States Patent [19]

Daly et al.

[11] Patent Number: 5,875,861

[45] Date of Patent: Mar. 2, 1999

[54] DIFFERENT STIFFNESS ENERGIZERS FOR MF SEALS

[75] Inventors: Jeffery E. Daly, Cypress; David E. Pearce, Spring; Thomas A. Wick, Houston, all of Tex.

[73] Assignee: Camco International Inc., Houston, Tex.

[21] Appl. No.: 685,851

[22] Filed: Jul. 24, 1996

[51] Int. Cl.[6] ..... E21B 10/22

[52] U.S. Cl. ..... 175/371; 277/336; 277/379; 384/94

[58] Field of Search ..... 175/371, 372; 384/94; 277/92, 336, 379, 382, 385

[56] References Cited

U.S. PATENT DOCUMENTS

| | | | |
|---|---|---|---|
| 3,137,508 | 6/1964 | Cunningham . | |
| 3,370,895 | 2/1968 | Carson, Jr. . | |
| 3,529,840 | 9/1970 | Durham et al. . | |
| 3,713,707 | 1/1973 | Bennett . | |
| 4,176,848 | 12/1979 | Lafuze | 277/92 |
| 4,178,045 | 12/1979 | Neilson . | |
| 4,199,156 | 4/1980 | Oldham et al. | 277/92 |
| 4,249,622 | 2/1981 | Dysart | 175/227 |
| 4,306,727 | 12/1981 | Deane et al. | 277/12 |
| 4,344,629 | 8/1982 | Oelke | 277/1 |
| 4,359,111 | 11/1982 | Gonzalez | 175/227 |
| 4,394,020 | 7/1983 | Oelke | 277/1 |
| 4,466,622 | 8/1984 | Deane et al. | 277/92 |
| 4,516,640 | 5/1985 | Karlsson | 175/227 |
| 4,516,641 | 5/1985 | Burr | 175/228 |
| 4,613,005 | 9/1986 | Olsson | 175/371 |
| 4,666,001 | 5/1987 | Burr | 175/371 |
| 4,671,368 | 6/1987 | Burr | 175/371 |
| 4,747,604 | 5/1988 | Nakamura | 277/83 |
| 4,753,303 | 6/1988 | Burr | 175/367 |
| 4,753,304 | 6/1988 | Kelly, Jr. | 175/371 |
| 4,762,189 | 8/1988 | Tatum | 175/371 |
| 4,822,057 | 4/1989 | Chia et al. | 277/84 |
| 4,824,123 | 4/1989 | Chia et al. | 277/84 |
| 4,838,365 | 6/1989 | Kotch | 175/371 |
| 4,903,786 | 2/1990 | Welsh | 175/367 |
| 4,923,020 | 5/1990 | Kelly, Jr. et al. | 175/372 |
| 5,009,519 | 4/1991 | Tatum | 384/94 |
| 5,040,624 | 8/1991 | Schumacher et al. | 175/371 |
| 5,295,549 | 3/1994 | Dolezal et al. | 175/371 |
| 5,360,076 | 11/1994 | Kelly et al. | 175/371 |

*Primary Examiner*—Hoang C. Dang

[57] ABSTRACT

A rolling cutter drill bit has at least one roller cutter mounted on a cantilevered bearing shaft with a sealed bearing and lubrication system, lubricant pressure balancing means, lubricant pressure relief means, and a volume compensating rigid face seal assembly axially movable through an operating range. The face seal assembly comprises two cooperating face seal rings, one ring mounted on the bearing shaft and the other ring mounted in the cutter; a first energizer for the seal ring mounted on the bearing shaft, having a stiffness K1; and a second energizer for the seal ring mounted in the cutter, having a stiffness K2. In order to minimize the variation in the sealing face force as the assembly moves through its operating range, the stiffness K2 is less than half, and preferably less than 0.2, of the stiffness K1.

21 Claims, 3 Drawing Sheets

DIFFERENT STIFFNESS ENERGIZERS FOR MF SEALS

BACKGROUND OF THE INVENTION

1. Field of the Invention

This invention relates to earth boring bits used in the oil, gas, and mining industry and in particular to rolling cone drill bits with lubricant systems sealed by volume compensating rigid face seals.

Modern sealed and lubricated earth boring drill bits (also called rock bits) have very limited space available for their dynamic lubricant seal. Furthermore, rigid bearings are not practical in these bits and axial and radial cutter movements with respect to the bearing shaft occur frequently during operation. Most sealed rock bits are designed to have some of this bearing play, resulting in some amount of axial displacement of the rolling cutter onward and offward the cantilevered bearing shaft during operation. An early, commercially successful Belleville type bearing seal for rock bits is shown in U.S. Pat. No. 3,137,508. This patent describes how movements of the rolling cutter cause volume changes in the lubricant which can generate large pressure differentials at the dynamic seal in the cutter. Later, when elastomeric packing ring type seals were developed for rock bits in the late 1960's, they were more tolerant of the pressure differentials and quickly replaced the Belleville spring seal in premium rock bits.

In spite of the limited space and extreme environment, there are many potential benefits in providing rigid face seals in rock bits. Therefore, there are many rigid face seal designs for rock bits which strive to minimize the effects of these pressure fluctuations of the lubricant near the seal caused by the bearing play. In U.S. Pat. No. 5,040,624 a large channel connects between the seal cavity and the pressure balancing diaphragm to minimize these pressure differentials. In another design, shown in U.S. Pat. No. 4,753,304, the geometry of the seal and bearing cavity is arranged such that lubricant volume changes next to the rigid face seal are minimized, thus minimizing pressure differentials caused by bearing play. In addition, there are many face seal designs that allow lubricant to be expelled from the bit in response to these pressure spikes.

Other similar rigid face seals for rock bits are shown in U.S. Pat. Nos. 3,370,895; 3,529,840; 4,176,848; 4,178,045; 4,199,156; 4,249,622; 4,306,727; 4,344,629; 4,359,111; 4,394,020; 4,516,640; 4,613,005; 4,747,604; 4,762,189; 4,822,057; 4,824,123; 4,838,365; and 5,009,519.

A common characteristic of all the above rigid face seal designs is that they cannot displace an effective volume of lubricant near the bearing to limit the pressure fluctuations caused by the bearing play. The above designs either have very limited axial movement and therefore are prevented from sweeping through a volume, or they are arranged in a manner where they do not displace a volume as they move. None of these designs have had widespread commercial success, due in part to this inability to effectively compensate for lubricant volume changes caused by bearing play. These seal designs are known as non-volume compensating type face seals, and the above patents are listed primarily for background information.

One of the above non-compensating face designs, shown in U.S. Pat. No. 4,838,365, is the ancestor of the present invention. Several bits with this particular non-volume compensating face seal were field tested. However, the non-volume compensating metal face seals in these bits did not meet expectations due to sealing face overload and excessive slippage of the shaft ring energizer. It is doubtful that these bits would perform even as well as bits with elastomer seals if run in a severe drilling environment.

In 1985 a volume compensating rigid face seal for rock bits was invented by Burr and granted U.S. Pat. No. 4,516,641. Burr designed a rigid face seal assembly for rock bits which moved axially within a groove in response to local lubricant volume changes near the bearing caused by axial displacement of the cutter. The axial movement of this seal minimized the pressure differentials caused by axial displacement of the cutter. Therefore, as axial and radial cutter movement occurred due to bearing play, there was minimal net lubricant volume change adjacent to the seal within the cutter. This design is known as a volume compensating seal because it is a rigid face seal assembly which moves axially in either direction from an equilibrium position in response to local lubricant volume changes.

There is enough clearance in each end of the seal cavity to accommodate the axial travel of the seal anticipated within the cutter during normal operation. The pressure variations generated during volume compensation are relatively small and are related to the stiffness of the seal's energizers and the effective area swept by the seal. Other rigid face seals for rock bits which could be considered volume compensating are shown in U.S. Pat. Nos. 3,713,707; 4,306,727; 4,466,622; 4,666,001; 4,671,368; 4,753,303; 4,903,786; 4,923,020; 5,295,549; and 5,360,076.

Although many of these seal designs are successful, they are not without problems. One weakness of these prior art volume compensating face seals is unintended rotation of the bearing shaft seal and energizer ring upon the cantilevered bearing shaft. This rotation often leads to destruction of the shaft energizer. Unintended rotation of the seal ring mounted on the bearing shaft is a well documented problem in prior art volume compensating rigid face seals. Means to prevent this rotation are addressed in previously referenced U.S. Pat. Nos. 4,306,727; 4,466,622; and 5,295,549.

A second problem in these prior art rigid face seal designs is that the force on the seal face can vary during operation as the seal assembly moves in response to lubricant volume changes. If the sealing face force were to drop significantly, lubricant could be lost from, or drilling fluid could enter, the bearing cavity, leading to rapid bearing degradation of the bit. Also, a large increase from the initial sealing face load can cause excessive heat generation and adhesive wear at the sealing faces, leading to failure of the seal.

Another problem with all rigid face seals in rock bits is abrasive wear of the sealing faces caused by intrusion of fine abrasives from the drilling fluid. Typically a 0.040 inch to 0.060 inch wide, smooth and flat sealing band is formed upon the sealing faces. The sealing band on these seal faces is placed as closely as possible to the outer periphery of the seal rings to minimize the intrusion of abrasive particles. This slows abrasive wear of the sealing faces, but does not prevent it.

Adhesive wear of the seal faces is caused by asperity contact of the mating seal faces. If the seals are made from materials which resist adhesive wear, the abrasives can still intrude into the edge of the seal face, cause abrasive wear, and slowly cause the sealing band to become ever narrower until there is no flat sealing band left to seal. At this point, abrasive laden drilling fluid may enter the bit and cause bearing failure.

Consequently, a common strategy is to make the seal rings with a material and a geometry so that normal material loss from the sealing faces from adhesive wear will cause the sealing band to widen. As abrasive wear reduces the width of the seal band from the periphery, the adhesive wear causes the seal band to expand toward the inside diameter of the seal ring. If everything is properly designed, the arrangement maintains an equilibrium seal band width. The end result is a sealing band that stays about 0.040 inches to 0.060 inches wide and slowly precesses toward the inside diameter of the seal ring. Variations in sealing face load can profoundly affect this equilibrium and unexpected wear patterns can still lead to premature seal failure.

Finally, the prior art does not address the problem associated with differential pressurization of the lubricant with respect to the drilling fluid. Pressure balancing diaphragms in rock bits are typically used in association with a lubricant pressure relief means. These devices typically allow the lubricant to become differentially pressurized to 100 to 200 PSI greater than the drilling fluid under some types of drilling conditions before they expel lubricant into the drilling fluid to limit the pressure buildup. A volume compensating rigid face seal in a rock bit may be moved within its cavity by this sustained pressure differential leading to the same type of sealing face force variations described earlier. Under extreme conditions the seal assembly could move so far that it contacts the end of the seal groove. When this happens, the seal loses its ability to compensate for lubricant volume changes—possibly causing very rapid seal failure.

The present invention provides a volume compensating rigid face seal which mitigates the above problems. The invention provides a rigid face seal for a rock bit which minimizes the variation in face loads as the seal assembly moves in response to lubricant volume changes. Another feature of the invention is that slippage of the shaft energizer is also minimized. Finally, a bit made in accordance with the present invention has a volume compensating rigid face seal which better tolerates differential pressurization of the lubrication with respect to the drilling fluid.

SUMMARY OF THE INVENTION

In a rock bit of the present invention, the two energizers for the seal rings of a volume compensating rigid face seal assembly are made with significantly different stiffnesses. In particular, the energizer for the seal ring mounted in the cutter has much less stiffness than the energizer for the seal ring mounted upon the cantilevered bearing shaft. The different energizer stiffnesses change the seal assembly's response to pressure differentials, minimizing face load variation and shaft energizer slippage.

The present invention reduces the change in sealing face force as the seal moves axially within its cavity due to volume compensation or during differential pressure increases of the lubricant. Minimizing face load variation minimizes the lubricant loss and contaminant ingress of the prior art volume compensating rigid face designs when the seal assembly moves in such a way as to reduce sealing face force. In the same way, when the prior art seal assembly moves axially in the opposite direction, the sealing face force increase can overload the faces leading to failure. Again, a bit made in accordance with this invention will minimize this sealing face load increase.

The present invention can theoretically maintain the sealing face force within +/−5% of the initial sealing face load as the seal traverses through its entire range of axial movement. Conversely, in the prior art designs, the sealing face load can theoretically vary more than +/−50% of the initial sealing face load as the seal traverses through its entire range of axial movement.

A further benefit of the present invention is that minimizing the variation in sealing face force also minimizes the variation in face torque. As sealing face torque increases, so does the tendency for slippage of the energizer mounted on the bearing shaft. Since the invention minimizes face torque changes, rotation of the bearing shaft seal ring on the bearing shaft is greatly reduced from the prior art volume compensating rigid face seals.

The above features of the present invention are unique with respect to its ancestor shown in U.S. Pat. No. 4,838,365, and testing has shown it to be superior. In fact, extensive field testing of bits made in accordance with the present invention and run in severe drilling environments has shown that this new design far out performs similar bits with elastomeric seals run under similar conditions.

It is an object of this invention to provide a rolling cutter drill bit having at least one roller cutter and cantilevered bearing shaft with a sealed bearing and lubrication system, a lubricant pressure balancing means, a lubricant pressure relief means and a volume compensating rigid face seal assembly axially movable through an operating range, comprising two cooperating face seal rings, one ring mounted on the bearing shaft and the other ring mounted in the cutter; a first energizer for the seal ring mounted on the bearing shaft, said first energizer having a stiffness K1; a second energizer for the seal ring mounted in the cutter having a stiffness K2; where the stiffness K2 is less than half of the stiffness K1.

It is a further object of this invention to provide a rolling cutter drill bit with at least one roller cutter and cantilevered bearing shaft with a sealed bearing and lubrication system, a lubricant pressure balancing means, a lubricant pressure relief means and a volume compensating rigid face seal assembly axially movable within a cavity through a operating range, said seal assembly at an axial equilibrium position within the cavity upon assembly of the bit; said cavity having a bearing shaft end wall and a cutter end wall defining with said seal assembly a bearing shaft axial clearance and a cutter axial clearance to allow axial movement of the seal assembly within said cavity; where said bearing shaft axial clearance is at least 10% greater than said cutter axial clearance.

DESCRIPTION OF THE INVENTION

Figure 2:
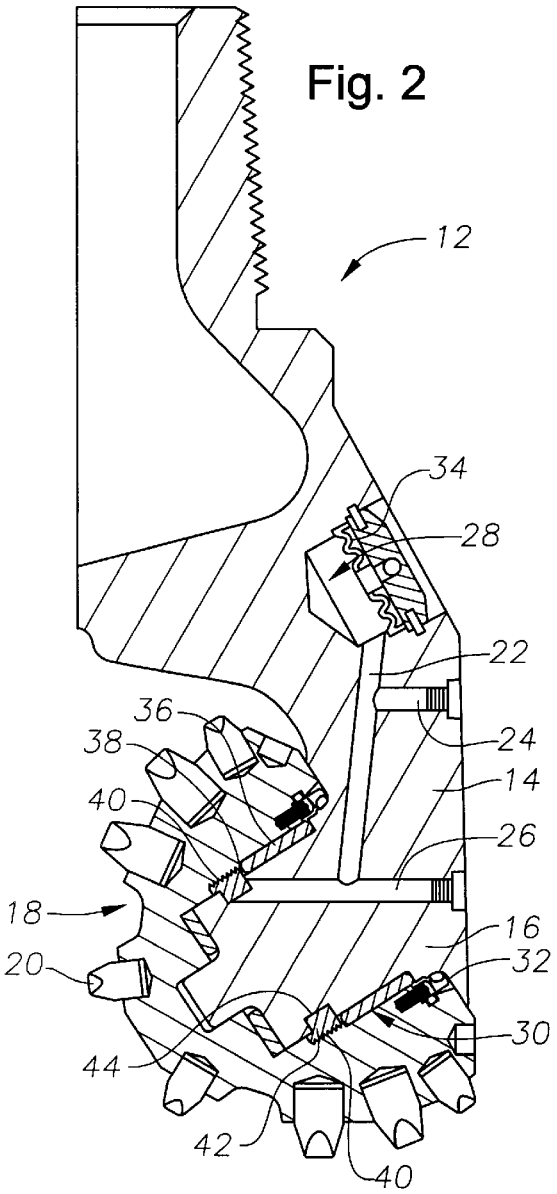
FIG. 2 is a cross section view through one leg of a rolling cutter drill bit with a volume compensating rigid face seal assembly of the present invention.
Figure 1:
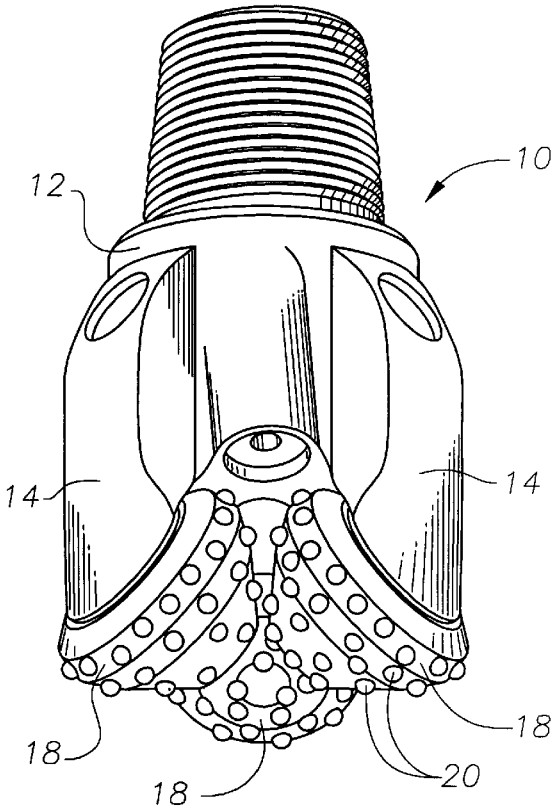
FIG. 1 is a perspective view of a typical rolling cutter drill bit.

Referring now to the drawings in more detail, and particularly to FIGS. 1 and 2, a rolling cutter earth boring bit 10 includes a body 12 with a plurality of leg portions 14. A cantilevered bearing shaft 16 formed on each leg 14 extends inwardly and downwardly. A rolling cutter 18 is rotatably mounted upon the shaft 16. Attached to the rolling cutter 18 are hard, wear resistant cutting inserts 20 which engage the earth to effect a drilling action and cause rotation of the rolling cutter 18. A friction bearing member 36 is mounted between the bearing shaft 16 and a mating bearing cavity 38 formed in the cutter 18. This friction bearing 36 is designed to carry the radial loads imposed upon the cutter 18 during drilling. A retention bearing member 42 is configured as a split threaded ring which engages internal threads 40 in the cutter 18. This retention bearing member 42 serves to retain the cutter 18 upon the bearing shaft by resisting the forces which tend to push the cutter 18 off the bearing shaft 16 during drilling.

Internal passageways 22, 24, & 26, as well as a reservoir 28 and bearing area 30 of the leg 14, are filled with lubricant (not shown) during bit assembly. The lubricant helps reduce bearing friction and wear during bit operation and is retained within the cutter 18 by a volume compensating rigid face seal assembly 32.

In the previously referenced U.S. Pat. No. 3,137,508 movements of the rolling cutter cause volume changes in the lubricant which can generate large pressure differentials at the dynamic seal in the cutter. Gradually varying, intransient pressure differentials between the lubricant and the external environment of the bit are equalized by the movement of a pressure balancing diaphragm 34. However, the diaphragm 34 cannot usually accommodate comparatively rapid changes in pressure differential which result, for example from rapid axial movement of the cutter 18 on the bearing shaft 16. The pressure balancing diaphragm 34 also has a built in pressure relief means which releases lubricant into the drilling fluid when a predetermined pressure differential, usually between 100 PSI and 200 PSI, is reached. This is intended to protect the bearing seal 32 and pressure balancing diaphragm 34 against unintended rupture or damage. These types of pressure relief mechanisms, as well as many other pressure relief designs, are well known in the art.

Figure 3:
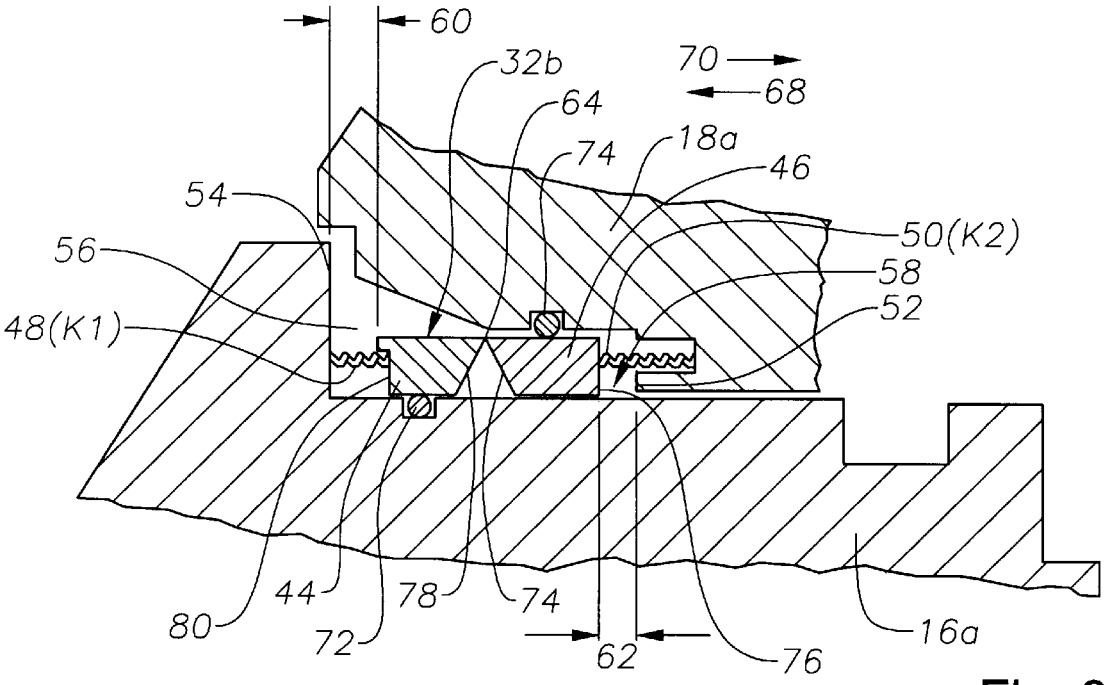
FIG. 3 is a schematic view of an idealized volume compensating rigid face seal to demonstrate effects of various energizer stiffnesses.

An enlarged schematic view of a section of an idealized volume compensating rigid face seal assembly 32*a* for rock bits is shown in FIG. 3. This schematic is helpful in demonstrating the effects of seal movement, energizer forces, and face loading as the stiffnesses of the energizers are varied. This seal assembly 32*a* is comprised of two seal rings 44 and 46 and two energizers 48 and 50 within a seal cavity 56 and 58. Energizers 48, 50 can take many forms, such as elastomeric O-rings, Belleville springs, sets of coil compression springs, and the like. For this idealized analysis, simple compression springs are shown. The seal ring 44 and the energizer 48 are mounted on the bearing shaft 16*a,* and the seal ring 46 and energizer 50 are mounted on the cutter 18*a*.

The portion of the seal cavity identified by numeral 56 fills with abrasive laden drilling fluid during operation. The other portion of the seal cavity, identified by numeral 58, is filled with lubricant. The bearing shaft energizer 48 is shown compressed between the bearing shaft seal ring 44 and a wall 54 formed on the bearing shaft 16*a*. The energizer 48 acts to load the seal ring 44 axially against the mating seal ring 46 to effect a seal. The magnitude of this load will vary as the seal ring 44 moves axially in the cavity 56, 58. A static seal 72 is placed between the seal ring 44 and the bearing shaft 16. In a similar manner, the cutter energizer 50 and static seal ring 74 perform the same functions, except that the cutter energizer 50 is compressed between the cutter seal ring 46 and a wall 52 formed in the cutter 18*a*.

In accordance with the teachings of U.S. Pat. No. 4,516,641, the operating range for the axial movement of seal assembly 32*a* is determined from the expected axial play of the bearing assembly and the volume ratio. This prior art, however, did not recognize the need to also include into the operating range axial movements of the seal assembly 32*a* due to intransient lubricant pressure differentials. Therefore, in accordance with the present invention, the operating range is determined from the expected axial play of the bearing assembly and the volume ratio with an additional allowance for seal movement without axial movement of the cutter caused by intransient lubrication pressure differentials. The axial bearing play of the cutter 18*a* on the bearing shaft 16*a* is included in this operating range. The maximum possible operating range is equal to the sum of cavity clearances 60 and 62 plus the axial bearing play. In practice it is desirable to design the seal and seal cavity with an operating range less than this so the seal assembly does not contact either end wall 52 or 54 during operation.

The range of axial displacement of the bearing shaft seal ring 44 with respect to the wall 54 will not necessarily be equal to the range of axial displacement of the cutter seal ring 46 with respect to the wall 52 as the seal assembly 32*a* moves through the operating range. This is due to the interdependence of the cutter axial play on the bearing shaft and the axial distance the seal assembly 32*a* moves to compensates for changes in lubricant volume.

A stiffness, K1, for the bearing shaft energizer 48 is defined as the maximum minus the minimum axial load the bearing shaft energizer 48 exerts over the range of axial displacement of the bearing shaft seal ring 44 with respect to the bearing shaft wall 54 divided by the amount of that axial displacement, as the seal assembly 32*a* traverses through its full operating range of movement. The units for this stiffness are therefore force divided by distance ($F.L^{-1}$).

A stiffness, K2, is defined in a similar manner for the cutter energizer 50 as the maximum minus the minimum axial load the cutter energizer 50 exerts over the range of axial displacement of cutter seal ring 46 with respect to the cutter wall 52 divided by the amount of that axial displacement, as the seal assembly 32*a* traverses through its full operating range of movement. Stiffness K2 also has the units of force divided by distance ($F.L^{-1}$). The load variation on either energizer as it moves through an intermediate position is continuous but not necessarily linear.

A dynamic sealing point 64 is defined on the engaged faces of the seal rings 44 and 46. In practice, this point is the center of a 0.040"–0.060" wide flat and smooth sealing surface on the seal faces of rings 44, 46. However, for clarity in this example, the dynamic seal point 64 is placed at the very edge of the sealing faces, closely adjacent to the abrasive drilling fluid portion of the seal cavity 56. It would be appreciated by those skilled in the art that it is desirable to locate this sealing point 64 as closely as possible to this edge to minimize face wear due to the presence of abrasive particles from the drilling fluid between the sealing faces.

The seal assembly 32*a* is called a volume compensating seal design because it sweeps a volume of lubricant in response to the volume change of lubricant that would normally be displaced by axial bearing play. Although the amount of seal movement is determined by the swept volume relationships, it is the pressure differentials acting upon the swept area of the seal 32*a* that force seal movement. It is in the understanding of how these pressure differentials act on the seal assembly that the utility of the present invention is appreciated.

In the idealized model of FIG. 3, both energizers 48 and 50 are compressed sufficiently to provide a nominal sealing force at the sealing face. When axial play in the bearing causes a discrete volume change in the lubricant near the seal assembly 32*a*, the seal assembly moves a discrete amount to compensate for the change in the volume of lubricant.

The seal moves in response to the pressure differential which arises between the cavities 56 and 58 as a result of the movement of the cutter on the bearing shaft. Since the sealing point 64 is at the very edge of the seals, the pressure in the cavity 58 acts on the entire face side 74 and the entire wall side 76 of the seal ring 46. Therefore none of the differential pressure between the cavities 58 and 56 act on the seal ring 46 in the axial direction.

On the other hand, the entire face side 78 of the seal ring 44 is subjected to the pressure in cavity 58 and the entire wall side 80 of ring 44 is subjected to the pressure in cavity 56. Therefore, seal ring 44 is fully subjected to the pressure differential between the cavities 58 and 56 in the axial direction. Thus, in this example the force arising from the pressure differential which causes axial seal movement is exerted solely upon the seal ring 44.

Since the entire force of differential pressure acting on the seal assembly 32*a* acts on ring 44, as the seal assembly 32*a* moves axially, the change in sealing face force is determined solely by the change in the force of the energizer 50.

The change in force of energizer 48 due to the axial movement of the seal assembly 32*a* is also important to understand. The changes in this force affect the tendency for bearing shaft seal ring 44 to rotate upon the bearing shaft (also known as seal ring slippage). In practice, the torque exerted upon the seal ring 44 is transferred through the energizer 48 to the bearing shaft. The manner in which this energizer is commonly used in practice relies upon frictional resistance between the energizer 48 and bearing shaft 16*a* to transmit this torque. The force within this energizer 48 can therefore be thought of as a grip force. Should the grip force within this energizer be significantly reduced, the likelihood of seal ring slippage increases.

Using the model of FIG. 3, the force change in energizer 48 (i.e. the change in grip force) is equal to the axial movement of the seal assembly with respect to the bearing shaft 16*a* multiplied by the stiffness K1 of energizer 48.

In the idealized model of FIG. 3 it is apparent that the variation in sealing face force depends solely upon the stiffness K2 of energizer 50 and the magnitude of axial movement of the seal ring 46 with respect to the cutter 18*a*. In addition, the axial force variation within energizer 48 (grip force variation) depends solely upon it's stiffness K1 and the magnitude of axial movement of the seal ring 44 with respect to the bearing shaft 16*a*. This inter-relationship is important when one realizes that in practice, the axial force variations within energizer 48 combined with the variations in sealing face force changes have a profound effect upon the amount of slippage between the bearing shaft seal ring 44 and the bearing shaft 16*a*.

To summarize, there are two formulas which can be applied to rock bit rigid face seal design which allow comparisons of different energizer stiffness as the seal assembly 32*a* moves axially within the seal cavity from an equilibrium position.

$$Dff=K2*D46$$

$$Dgf-K1*-D44$$

where all axial displacements to the right as indicated by numeral 70 are positive, and:

Dff=change in sealing face force

Dgf=the force change in energizer 48 (also called grip force change)

K1=stiffness of energizer 48

K2=stiffness of energizer 50

D46=change in axial position of seal ring 46 with respect to the cutter 18*a*

D44=change in axial position of seal ring 44 with respect to the bearing shaft 16*a*

The following are approximate values of prior art energizer stiffness taken from information given in U.S. Pat. Nos.: 4,516,641 column 5 line 41, 4,671,368—column 4, lines 30–44, and 4,923,020, FIG. 5. These stiffnesses are tabulated as K1 and K2 so comparisons can be made with the idealized geometry of FIG. 3.

| | U.S. Pat. No. | Stiffness K1 lb/in | Stiffness K2 lb/in |
|---|---|---|---|
| Design A | 4,516,641 | 3000 | 3000 |
| Design B | 4,671,368 | 820 | 1680 |
| Design C | 4,923,020 | 1600 | 1600 |
| Present invention | | 2500 | 420 |

Figure 4:
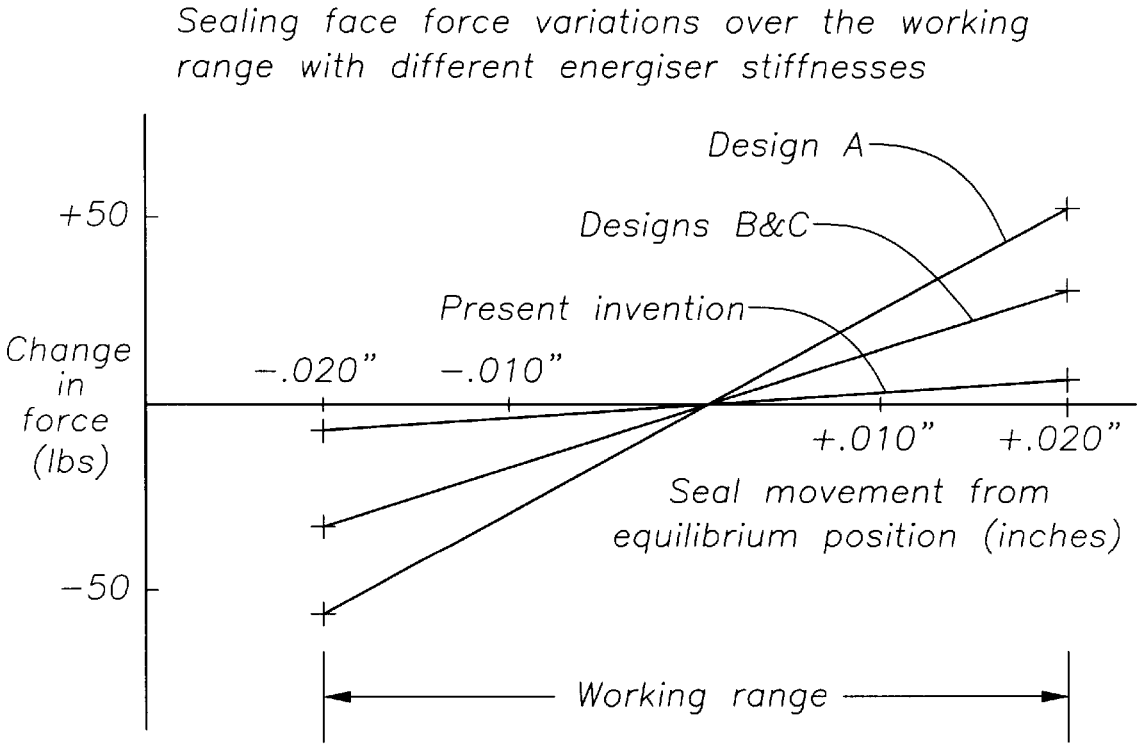
FIG. 4 is a series of graphs showing how sealing face force varies over the operating range with different energizer stiffnesses.

Referring now to FIG. 4, shown is a family of curves representing the changes in sealing face force plotted against seal movement through a 0.040" operating range for the four cases described above. For comparison purposes, in this idealized model, the change in sealing face force plotted against seal movement is shown as being linear. In practice, however, it is known that non-linearities occur between the end points and the center equilibrium position, especially when the energizers are resilient elastomers.

Note from the graphs of FIG. 4 that the variation in sealing face force for the present invention is much less than that of the prior art designs A–C. In fact, if an 80 pound initial face force is assumed with a total operating range of axial seal movement of 0.040", the present invention has only a +/−10% variation in sealing face force over the operating range. Using the same assumptions, the prior art designs A, B and C respectively each exhibit more than a +/−75%, +/−42% and a +/−40% variation in sealing face force over the operating range.

Of particular concern is the reduction in sealing face force that occurs with negative seal assembly displacements. As can be seen from this idealized model, a −0.020 inch movement can reduce the face force by 60 lbs. Because this reduction in face force is accompanied by an increase in differential pressure, there is a potential for lubricant leakage with prior art designs that is greater than with the present invention.

This situation is further exacerbated when the lubricant is differentially pressurized to some amount higher than the drilling fluid. Internal pressurization moves the seal 32*a* to a new quasi-equilibrium position to the left (in the direction of numeral 68) of the assembled equilibrium position. In this new quasi-equilibrium position energizer 50 is partially relaxed, and the seal assembly 32*a* will have a reduced sealing face load, further increasing the potential for lubricant leakage of the three prior art designs.

It should also be appreciated from the graphs of FIG. 4 that when volume compensation of the seal assembly 32*a* causes seal movement to the right, as indicated by numeral 70 in FIG. 3, the sealing face force increases. Because an increase in sealing face force is usually accompanied by an increase in the torque transmitted through the sealing faces, there is an increased tendency for the bearing shaft seal ring 44 to turn with respect the to bearing journal 16*a*. The situation is further aggravated because as the seal assembly moves to the right, the force in the bearing shaft energizer 48 (grip force) decreases. Since the sealing face force in the current invention does not increase as rapidly as that of the prior art designs there is less tendency for this slippage to occur.

The following example demonstrates how the above energizer stiffnesses will affect the forces on and within the seal assembly 32*a* of FIG. 3 during a volume compensation event. Assume for this example that drilling conditions forced a sudden axial movement of the cutter of 0.012 inches away from the bearing journal. The seal assembly 32*a* will move toward the cutter 18*a* in response to a volume change in the seal cavity 58. Further, assume that the bearing and seal design causes a ratio of seal assembly 32*a* movement to cutter 18*a* movement of 1.88:1 as described in U.S. Pat. No. 4,516,641 column 6 lines 65–67. With these numbers, the seal assembly will move 0.023 inches. This movement will add (0.023–0.012) or 0.011 inches of compression to the cutter energizer 50, and will result in a 0.023 inch relaxation of the shaft energizer 48.

Using the energizer stiffnesses from the prior art and the present invention in the idealized seal design of FIG. 3, the following table summarizes the force changes in the sealing face, the force in energizer 50 using the formulas previously defined:

$$Dff = K2 * D46$$

$$Dgf = K1 * -D44$$

| | Change in sealing face force, lbs(Dff) | Change in shaft energizer 48 force, lbs(Dgf) |
|---|---|---|
| Design A | 33 | −69 |
| Design B | 18 | −19 |
| Design C | 18 | −37 |
| Present invention | 5 | −58 |

It should be noted that space constraints within rock bit bearings effectively limit the stiffness ranges of the bearing shaft energizers. In order to achieve a reasonable assembly face force and act both as an energizer and a static seal in the space available, the stiffness of the bearing shaft energizer for commercially successful designs has been generally between 2000 lb/in and 4500 lb/in. In the present invention the stiffness is between 2000 lb/in and 3500 lb/in. Therefore, only design A and the present invention are considered practical for use in commercial rock bits.

It is clear from the above table that the present invention is superior in minimizing face force variations and bearing shaft seal ring slippage as the seal assembly moves axially within the seal cavity compared to design A, the current commercial prior art rigid face seal design.

One final point is that a volume compensating rigid face seal of the present invention will also have a slower and more predictable wear progression of the sealing band than prior art designs. This is due to less fluctuation in face loads of the present invention compared to the prior art designs.

The theoretical design of FIG. 3 is helpful in understanding the forces acting upon these rigid face seals. In practice, however, volume compensating rigid face seals for rock bits differ from the idealized seal design shown in FIG. 3. For example the bearing shaft energizer 48 and the static seal 72 are usually combined into a single elastomeric seal. Also, while the sealing point 64 is placed as near the seal O.D. as possible, it can not lie at the extreme edge of the seal as shown. This means that the differential pressures acting on the seal assembly 32*a* can act to a limited degree on the seal ring 46. Also, the pressure differentials can act on the energizers. Finally, there are friction forces which resist movement of the seal assembly, making exact, dynamic force predictions problematic. However, the underlying relationships illustrated herein between face force variations and seal movement within the operating range are still valid and the principles and interactions shown in FIG. 3 are applicable.

DESCRIPTION OF THE PREFERRED EMBODIMENT

Figure 5:
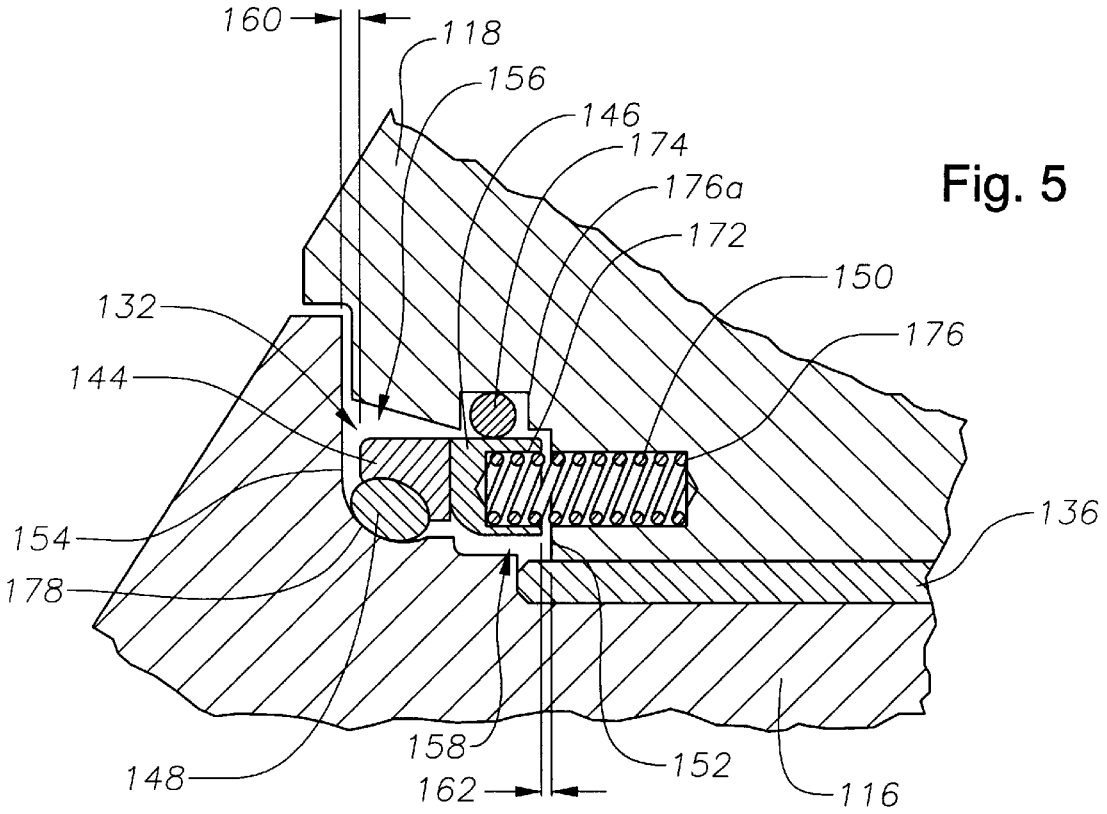
FIG. 5 is a cross section view of the preferred embodiment of the current invention.

The preferred embodiment of the new volume compensating rigid face seal assembly of the present invention is shown in FIG. 5. The seal assembly 132 is comprised of two seal rings 144, 146, energizers 148, 150, and static seal 174 separating seal cavities 156 and 158. Cavity 156 fills with abrasive laden drilling fluid during operation. Cavity 158 is filled with lubricant. Clearances 160, 162 within the seal cavity allow the seal assembly to move axially within the operating range between the bearing shaft wall 154 and the cutter wall 152. Clearance 160 is greater than 162 to allow for greater seal movement toward the bearing shaft due to the occasional intransient pressures which may build up in the lubricant. The clearance 160 is by design made at least 10% greater than clearance 162 to accommodate these pressure differentials.

The bearing shaft energizer 148 is an elastomer ring compressed between the bearing shaft seal ring 144 and a ramp 178 formed on the bearing shaft 116. The ramp 178 and the portion of the shaft seal ring 144 which contacts the energizer 148 are grit blasted prior to assembly to achieve a surface roughness of about 120 to 400 RA. The cutter energizer 150 is a plurality of coil springs 150. Coil springs 150 are particularly advantageous when cutter energizer stiffness, K2, is made very low. The coil springs 150 can be precisely engineered for any desired energizer stiffness by changing the spring wire material and diameter, number of coils in the spring and the total number of springs 150 in the seal assembly 132. The coil springs 150 are placed in recesses 172 in the cutter seal ring 146 and in recesses 176 in the cutter 118. This construction provides the advantage of eliminating energizer slippage and rotation of seal ring 46 relative to cutter 118.

The geometry of the seal and bearing design along with the axial play of the bearing and expected pressure differentials are all considered when calculating an operating range of the seal assembly 132 within the seal cavity 156, 158. The width of the seal cavity 156, 158 is designed to provide for adequate axial clearances as seal assembly 132 moves axially to provide volume compensation during operation.

Although stiffness up to about 1000 pounds per inch for K2 are considered effective to practice the invention, in the preferred embodiment, the total stiffness, K2, over the operating range of the coil springs 150 energizer is about 400 to 500 pounds per inch.

The static seal 174 in the preferred embodiment is an elastomeric packing type seal ring placed in a groove 176 formed in the cutter 118. The static seal ring 174 bears against the cutter ring 146, preventing the exchange of lubricant and drilling fluid around the cutter ring 146.

As stated earlier, in order to achieve a reasonable assembly face force and act both as an energizer and a static seal in the space available, the stiffness K1 of the bearing shaft energizer 148 generally lies between 2000 lb/in and 4500 lb/in. However, the practical constraints in the present invention limit the stiffness K1 to between 2000 lb/in and 3500 lb/in. Since the maximum effective stiffness of K2 is about 1000 lb/in and the minimum stiffness of K1 is about 2000 lb/in, in the practice of the present invention the stiffness K2 will be less than half of the stiffness K1. In the preferred embodiment, the bearing shaft energizer 148 is designed to have a stiffness, K1, over its operating range of about 2500 pounds per inch and is the equivalent to the combination of the bearing shaft energizer 48 and static seal 72 in FIG. 3. Therefore, in the preferred embodiment the stiffness K2 is less than about 0.2 of the stiffness of K1.

When one considers prior art rigid face seal designs, there are many ways to reduce the stiffness of energizer K2 to practice the present invention. One way to reduce the stiffness, K2, of cutter energizer 50 is by changing the dimensions and composition of the energizer 50. For example, if the energizer 50 is elastomeric, a softer elastomer can be used with similar space and geometry. Also, an elastomer O-ring with a larger cross section diameter could be used in a larger seal cavity or the geometric relationships of the mating surfaces between energizer 50 and the cutter seal ring 46 and the wall 52 can be changed to reduce stiffness K2.

Whereas the present invention has been described in particular relation to the drawings attached hereto, it should be understood that other and further modifications, apart from those shown or suggested herein, may be made within the scope and spirit of the present invention

What is claimed:

1. A rolling cutter drill bit with at least one roller cutter and cantilevered bearing shaft with a sealed bearing and lubrication system, a lubricant pressure balancing means, and a volume compensating rigid face seal assembly axially movable through an operating range effective for lubricant volume compensation while in operation, comprising two cooperating face seal rings, one ring mounted on the bearing shaft and the other ring mounted in the cutter;

a first energizer for the seal ring mounted on the bearing shaft, said first energizer having a stiffness K1;

a second energizer for the seal ring mounted in the cutter having a stiffness K2; where the stiffness K2 is less than half of the stiffness K1.

2. A rolling cutter drill bit according to claim 1, wherein the stiffness K2 is less than 0.2 of the stiffness K1.

3. A rolling cutter drill bit according to claim 1, wherein the stiffness K2 is less than 1000 pounds per inch.

4. A rolling cutter drill bit according to claim 1, wherein the stiffness K2 is in the range of about 400 to 500 pounds per inch.

5. A rolling cutter drill bit according to claim 4, wherein the stiffness K2 is about 420 pounds per inch.

6. A rolling cutter drill bit according to claim 1, wherein the stiffness K1 is in the range of about 2000 pounds to 3500 pounds per inch.

7. A rolling cutter drill bit according to claim 6, wherein the stiffness K1 is about 2500 pounds per inch.

8. A rolling cutter drill bit according to claim 1, wherein the first energizer comprises an elastomer and the second energizer comprises a helical compression spring.

9. A rolling cutter drill bit according to claim 1, wherein said rigid face seal assembly is axially movable within a cavity and is maintained by said first and second energizers in an axial equilibrium position within the cavity upon assembly of the bit; said cavity having a bearing shaft end wall and a cutter end wall defining with said seal assembly a bearing shaft axial clearance and a cutter axial clearance respectively to allow axial movement of the seal assembly within said cavity; and wherein said bearing shaft axial clearance is at least 10% greater than said cutter axial clearance when the seal assembly is in said axial equilibrium position.

10. A rolling cutter drill bit with at least one roller cutter and cantilevered bearing shaft with a sealed bearing and lubrication system, a lubricant pressure balancing means, a volume compensating rigid face seal assembly axially movable from an axial equilibrium position through an operating range effective for lubricant volume compensation while in operation, said equilibrium position established upon assembly of said roller cutter on said bearing shaft;

said face seal assembly comprising two cooperating face seal rings, one ring mounted on the bearing shaft and the other ring mounted in the cutter;

a first energizer for the seal ring mounted on the bearing shaft, said first energizer having a stiffness K1;

a second energizer for the seal ring mounted in the cutter, said second energizer having a stiffness K2;

said first energizer and said second energizer acting upon said two cooperating face seal rings to effect a sealing face force between said two cooperating face seal rings;

wherein said stiffness K2 is less than half said stiffness K1 whereby said sealing face force varies by substantially less than about 40 percent as said rigid face seal assembly moves axially from said equilibrium position through said operating range.

11. A rolling cutter drill bit of claim 10 wherein said sealing face force varies about ten percent or less as said rigid face seal assembly moves axially from said equilibrium position through said operating range.

12. A rolling cutter drill bit with at least one roller cutter and cantilevered bearing shaft with a sealed bearing and lubrication system, a lubricant pressure balancing means, a lubricant pressure relief means, and a volume compensating rigid face seal assembly axially movable from an assembled axial equilibrium position through an operating range effective for lubricant volume compensation while in operation, comprising two cooperating face seal rings, one ring mounted on the bearing shaft and the other ring mounted in the cutter;

a first energizer for the seal ring mounted on the bearing shaft, said first energizer having a stiffness K1;

a second energizer for the seal ring mounted in the cutter, said second energizer having a stiffness K2;

said first energizer and said second energizer acting upon said two cooperating face seal rings to effect an initial sealing face force between said two cooperating face seal rings as said face seal rings move axially through said operating range;

wherein said stiffness K2 is substantially less than said stiffness K1 whereby the variation in said sealing face force is substantially less than said initial sealing face force as said rigid face seal assembly moves axially from said equilibrium position through said operating range.

13. A rolling cutter drill bit according to claim 12 wherein the stiffness K2 is less half of the stiffness K1.

14. A rolling cutter drill bit according to claim 12 wherein the stiffness K2 is less than 0.2 of the stiffness K1.

15. A rolling cutter drill bit of claim 12 where the stiffness K2 is less than 1000 pounds per inch.

16. A rolling cutter drill bit of claim 12 where the stiffness K2 is in the range of about 400 to 500 pounds per inch.

17. A rolling cutter drill bit of claim 12 where the stiffness K2 is about 420 pounds per inch.

18. A rolling cutter drill bit of claim 12 wherein the stiffness K1 is in the range of about 2000 pounds per inch to about 3500 pounds per inch.

19. A rolling cutter drill bit of claim 12 wherein the stiffness K1 is about 2500 pounds per inch.

20. A rolling cutter drill bit of claim 12 wherein said sealing face force varies by substantially less than forty percent as said rigid face seal assembly moves axially from said equilibrium position through said operating range.

21. A rolling cutter drill bit of claim 12 wherein said sealing face force varies by about ten percent or less as said rigid face seal assembly moves axially from said equilibrium position through said operating range.

* * * * *